US006598648B1

(12) United States Patent
Schulte

(10) Patent No.: US 6,598,648 B1
(45) **Date of Patent: *Jul. 29, 2003**

(54) INDUSTRIAL DOOR SYSTEM RESPONSIVE TO AN IMPACT

(75) Inventor: Peter S. Schulte, East Dubuque, IL (US)

(73) Assignee: Rite-Hite Holding Corporation, Milwaukee, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/266,975

(22) Filed: Mar. 12, 1999

(51) Int. Cl.[7] ..... E05F 15/20
(52) U.S. Cl. ..... 160/1; 160/310; 49/28
(58) Field of Search ..... 160/265, 273.1, 160/310, 311, 312, 1, 7, 127, 237, 10, 405; 49/28, 27, 322

(56) References Cited

U.S. PATENT DOCUMENTS

| | | | | |
|---|---|---|---|---|
| 3,975,723 A | | 8/1976 | Bowling et al. | 340/274 R |
| 4,191,915 A | | 3/1980 | Johansson | 318/464 |
| 4,501,963 A | | 2/1985 | Perisic | 250/231 |
| 4,519,474 A | | 5/1985 | Iseli et al. | 180/279 |
| 4,639,713 A | | 1/1987 | Kitagawa et al. | 340/63 |
| 4,944,116 A | | 7/1990 | Mewald | 49/27 |
| 4,953,608 A | * | 9/1990 | Larsson | 160/1 |
| 5,025,847 A | | 6/1991 | Mueller | 160/270 |
| 5,027,552 A | * | 7/1991 | Miller et al. | 49/27 |
| 5,139,074 A | | 8/1992 | Warner | 160/271 |
| 5,141,044 A | | 8/1992 | Hying et al. | 160/271 |
| 5,142,822 A | * | 9/1992 | Beckerman | 49/27 |
| 5,214,293 A | | 5/1993 | MacNiel | 250/561 |
| 5,216,246 A | | 6/1993 | Weldman et al. | 250/229 |

(List continued on next page.)

FOREIGN PATENT DOCUMENTS

| | | |
|---|---|---|
| DE | 30 21 363 A1 | 12/1981 |
| EP | 0 671 532 A1 | 9/1995 |
| FR | 1.009.862 | 6/1952 |
| WO | WO 95/19486 | 7/1995 |

OTHER PUBLICATIONS

*International Search Report* corresponding to International Patent Application Ser. No. PCT/US00/06215, European Patent Office, dated Jun. 23, 2000, 6 pages.
Overhead Door JETROLL, Form A–988 10/95, Copyright Overhead Door Corporation 1995, 14 pgs.
Kelly TUFFLEX BEAM, Form 20–332, Copyright Kelley Company, Inc. 1993, 2 pages.

*Primary Examiner*—David M. Purol
(74) *Attorney, Agent, or Firm*—Marshall, Gerstein & Borun

(57) ABSTRACT

An impact sensing system for a powered roll-up door combines an electrical switch and a breakaway coupling. To avoid damage or injury resulting from the door's roll-up curtain accidentally closing upon an obstacle or something striking the curtain, the breakaway coupling responds to such a collision by breaking away, which releases a lower portion of the curtain from between its two vertical guide tracks. Each breakaway coupling includes a set of electrical contacts that make or break in response to the coupling breaking away. When the curtain's lower portion becomes effectively derailed from its guide track, the electrical contacts disable continued operation of the door to prevent the door's drive motor from jamming the curtain. In some embodiments, the breakaway coupling is releasably held together by way of magnetic attraction between two coupling segments, with one electrical contact on each segment to comprise one set of functional contacts.

9 Claims, 12 Drawing Sheets

U.S. PATENT DOCUMENTS 5,228,492 A * 7/1993 Jou ..... 160/1 X
5,271,448 A 12/1993 Delgado ..... 160/265
5,299,617 A 4/1994 Hying et al. ..... 160/271
RE34,665 E 7/1994 Strand ..... 250/221
5,335,749 A 8/1994 Taguchi et al. ..... 180/274
5,353,859 A 10/1994 Oltahfer et al. ..... 160/310
5,357,183 A 10/1994 Lin ..... 318/468
5,368,084 A 11/1994 Hying et al. ..... 160/265
5,384,982 A * 1/1995 Galperin ..... 49/27
5,420,430 A 5/1995 Trett ..... 250/341
5,450,888 A * 9/1995 Schwartzman et al. ..... 160/10
5,540,269 A * 7/1996 Plumer ..... 160/310 X
5,566,504 A 10/1996 Pitel ..... 49/28
5,576,581 A 11/1996 Iannuzzi et al. ..... 307/117
5,584,145 A 12/1996 Teich ..... 49/506
5,592,777 A 1/1997 Petri et al. ..... 49/28
5,596,840 A 1/1997 Teich ..... 49/26
5,632,317 A 5/1997 Krupke et al. ..... 160/265
5,638,883 A * 6/1997 Schulte ..... 160/265 X
5,655,585 A * 8/1997 Fry ..... 160/10
5,712,477 A 1/1998 Delaney, III et al. ..... 250/221
5,728,984 A * 3/1998 Miller ..... 49/28 X
5,743,317 A * 4/1998 Beringer et al. ..... 160/10
5,777,552 A 7/1998 Fischette et al. ..... 340/547
5,789,739 A 8/1998 Schwarz ..... 250/221
5,793,357 A 8/1998 Ivey et al. ..... 345/166
5,832,665 A 11/1998 Miller et al. ..... 49/27
5,839,227 A 11/1998 Gardner ..... 49/27
5,921,026 A 7/1999 Miller ..... 49/27
5,934,019 A 8/1999 Rotharmel et al. ..... 49/28
5,964,058 A 10/1999 Richardson ..... 49/27
5,964,270 A 10/1999 Kirkey et al. ..... 160/273.1
6,002,333 A 12/1999 Hickey ..... 340/550

* cited by examiner 12
38
48
46
52
40
44
86
60
56
20
42
50
62
32
46
48
42
52
44
40
38
60
50
20
12
32
62

66
80
64
68
78
82
10
18
14
70
12
16
12
22
76
22
24
46
32
52
48
34
56
54
58
62
40
42
38
72
50
60
26
28
32
46
48
52
36
56
54
62
60
74
38
84
2
2

12
62
48
46
60
50
40
44
86
52
38
20
42
56
32
46
48
86
42
52
44
40
38
60
62
50
20
12

66
80
64
78
68
82
18
10
14
70
12
16
12
22
76
22
24
32
46
52
48
34
30
56
54
40
38
72
50
26
28
36
62
60
74
84
4
4

INDUSTRIAL DOOR SYSTEM RESPONSIVE TO AN IMPACT

BACKGROUND OF THE INVENTION

1. Field of the Invention

The subject invention generally pertains to industrial doors having a pliable door curtain, and more specifically to a system responsive to a door impact.

2. Description of Related Art

Industrial doors in which the door itself is made of pliable material such as fabric are used in a variety of applications, typically for the purpose of separating areas within a building, or closing off building doorways that lead outside. Examples of such pliable doors are planar doors, overhead-storing doors, concertina doors and roll-up doors. Planar doors include frame members on which the fabric comprising the door is disposed. This plane of material is then movable between a doorway blocking position and a storage position, wherein the plane of material and associated frame members are disposed above the doorway. The frame typically includes extensions extending past either side of the door, and which are receivable within guide tracks to guide the door through its vertical movement. These extensions may include wheels or trolleys. An overhead-storing door is similar in that the fabric door is maintained on frame members and is movable between doorway blocking and storage positions. In this door, however, the storage position is overhead, as in a typical garage door. Accordingly, the guide members associated with such a door will curve between the vertical and horizontal. A concertina door includes a fabric panel supported by spaced-apart ribs or stays that are guided for movement along a track. As the ribs travel along the track, the fabric panel folds and unfolds between the ribs to respectively open and close the door. A typical roll-up door comprises a roll-up panel or fabric curtain that is wound about a roller journalled for rotation above the doorway. To close the door, the roller pays out the curtain as two vertical tracks disposed along either side edge of the doorway guide the side edges of the curtain generally along a vertical plane across the doorway. The rotation of the roller is reversed to open the door. Roll-up doors are typically either powered open and closed, or are powered open and allowed to fall closed by gravity. As the invention herein is envisioned for use primarily with roll-up doors, it will be described with reference thereto. However, the invention may also be used in combination with other such pliable industrial doors.

Some roll-up doors have a rigid leading edge provided by a rigid or semi-rigid bar disposed along a lower portion of the curtain. The rigidity of the bar helps keep the curtain within the side tracks and helps the curtain resist wind and other air pressure differentials that may develop across opposite sides of the door.

Other roll-up doors, however, have a curtain with a relatively soft leading edge. To help keep such a curtain within its guide tracks, as well as keep the curtain taut and square to the doorway, opposite ends of the bottom portion of the curtain can be held in tension by two opposing carriages or trolleys that are constrained to travel along the tracks: one in each track. However, the door's lower leading edge does not necessarily have to be held in tension, especially when the door is not subject to significant pressure differentials.

Industrial doors are commonly installed in warehouses, where the doors are very susceptible to being struck by forklifts or other vehicles. To protect the door and the vehicle from damage and to protect personnel in the vicinity of the collision from injury, often some type of breakaway or compliant feature is added to the door. For a door having a rigid reinforcing bar along its leading edge, the bar may be provided with sufficient flexibility and resilience to safely pop out of its track when struck. Alternatively, a hard edge door may have its bottom bar connected at either end to carriages engageable with the tracks such that the bottom bar breaks away from the carriages for an impact. Doors having a relatively soft leading edge may have sufficient flexibility to absorb an impact, or a bottom portion of the door's curtain can be coupled to its two guide carriages by way of a breakaway coupling. The coupling releases the curtain from the carriage upon being subjected to a predetermined breakaway force, thereby limiting the impact force to a predetermined safe level. More information on break away couplings can be found in U.S. Pat. No. 5,638,883, which is specifically incorporated by reference herein.

A collision can also occur when a door accidentally closes upon an obstacle in its path, such as an object or a person. To protect the door and obstacle from damage or injury, often some type of switch is installed generally along the lower portion of the door to detect when an obstacle has been encountered. An example of such a switch would be an elongated bumper switch, tape-switch or some other elongated switch extending along the lower, leading edge of the roll-up panel. In reaction to sensing the obstacle upon impact, a set of electrical contacts of the switch typically close to stop or reverse the motor that drives roller.

However, switches are impractical for use on a door having a relatively soft leading edge, because the normal flexing of the door curtain could trip the switch prematurely. This can happen regardless of whether the soft leading edge of the curtain is held taut or left relatively loose. Therefore, some doors with a soft leading edge instead include a switch with closed biased contacts that are held open by the tension in the leading edge of the curtain. When an impact forces the leading edge of the curtain to break away from its guide tracks, the resulting release of tension within the curtain allows the switch's contacts to close, The closed contacts provide a signal that can be conveyed to the door's control circuit or an alarm circuit by way of a wire or battery powered radio transmission. Alternatively, a sensing mechanism may be associated with the guide carriages or trolleys associated with the soft edge. This sensing mechanism has a first state when the breakaway connection to the leading edge is intact, and a second state upon breakaway. This change to this second state is detected to stop or reverse the door.

In hard edged doors with a tape switch or other elongated switch, such elongated switches are typically inserted into a sheath attached to the curtain or incorporated within the curtain itself to allow a more durable or suitable sealing member to be installed just below the switch. This allows the very bottom or leading edge of the roll-up panel to be provided with a more compliant sealing material that can effectively conform to seal against the floor beneath the doorway when the door is closed. However, installing switches in such a manner, makes them rather inaccessible for servicing. Serviceability is particularly important, as the switch itself, being disposed along the lower portion of the roll-up panel, places the switch's electrical contacts and other electrical parts in a vulnerable position where they are subject to repeated impacts that could eventually damage the switch.

Further, when such a switch is used on a door having a breakaway coupling, wiring connecting the switch to a terminal associated with the motor's control needs to accommodate the separation of the coupling. That is often accomplished by running a separate coiled wire (i.e., multi-conductor cable) along the outside of the track and extending the wire from the terminal to the switch. Such a wire is usually coiled so it can stretch to accommodate the up and down motion of the door panel as well as the motion of the panel upon breaking away from its carriage. However, an exposed coiled wire can be unsightly, especially when it becomes permanently stretched out from use and begins to sag. As the wire sags, it becomes prone to snagging adjacent parts of the door or other items nearby.

SUMMARY OF THE INVENTION

In order to more effectively synthesize a safety switch with a breakaway coupling of a roll-up door, there is provided a breakaway coupling that includes at least one electrical contact that remains coupled to a guide carriage of the door even after the coupling disengages the door's roll-up panel from the carriage.

This eliminates the need for externally running a separate coiled or otherwise flexible wire out to the roll-up panel.

It also positions the electrical contacts of the switch at a more serviceable location and at a location that is beyond the impact-vulnerable central portion of the roll-up panel's leading edge.

In some embodiments, the electrical contacts of the switch are an integral part of the breakaway coupling itself, which is relatively more rugged than the small delicate electrical contacts of a conventional electrical switch.

By integrating a safety switch with an omni-directional breakaway coupling, the switch also becomes omni-directional in that it is responsive to an impact from any direction.

There is also provided an impact detection system wherein the sensing circuit includes a conductor that extends across the width of the doorway. For normal door operation, the conductor conducts electricity as part of the sensing circuit. For an impact, however, the conductor is no longer a conductive part of the circuit. This change can be detected and interpreted as an impact having occurred.

There is also provided a breakaway coupling wherein a member associated with a door guide track (e.g., a trolley or guide carriage) and a conductor are in electrical, conductive contact for normal door operation, and are not in conductive contact for a breakaway condition.

DESCRIPTION OF THE PREFERRED EMBODIMENT

Figure 1:
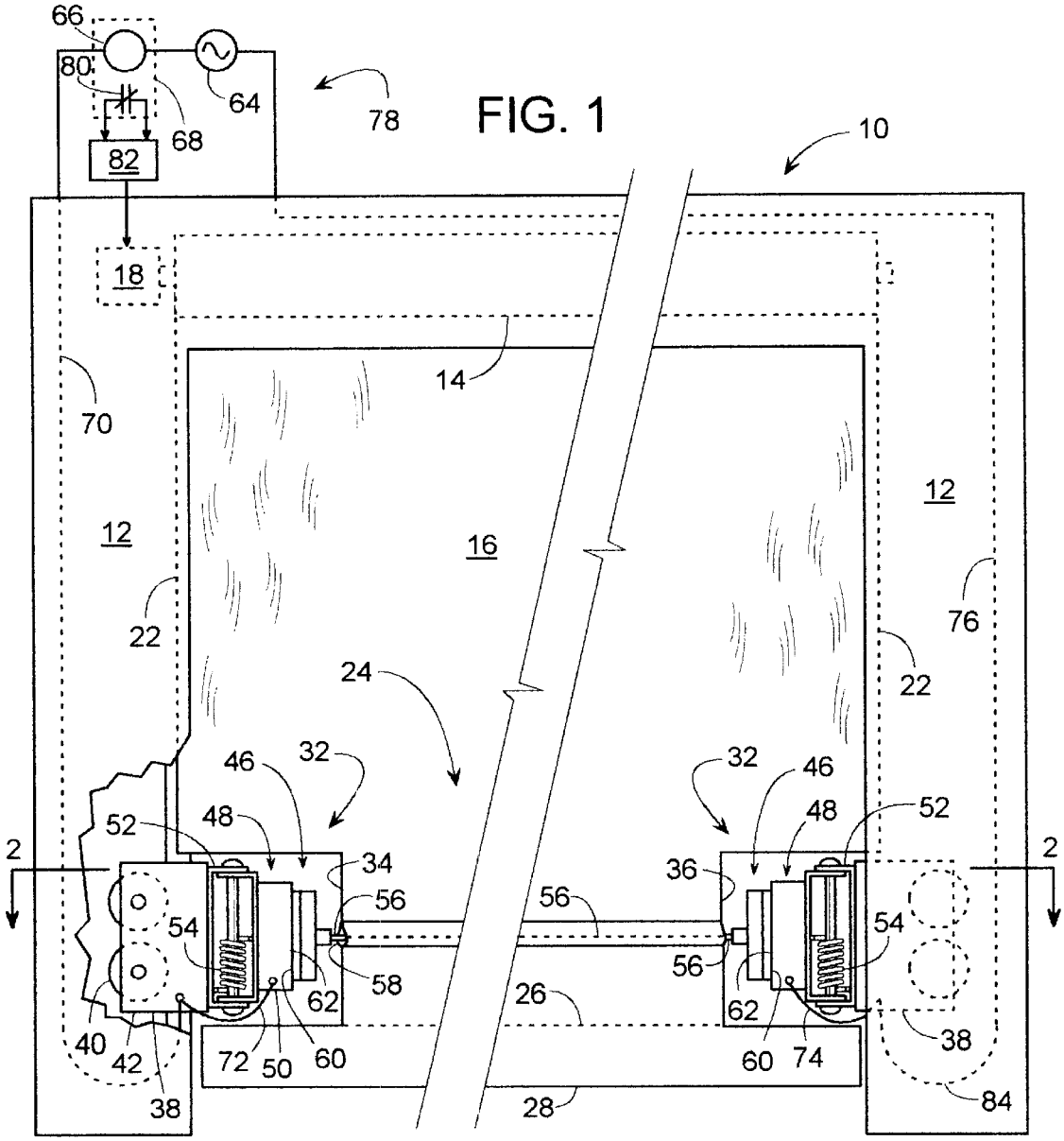
FIG. 1 is a front view of one embodiment with a cut-away portion showing a breakaway coupling.

To provide a more durable and readily accessible elongated switch for use along a lower portion of a roll-up door panel releasably held by a breakaway coupling, the embodiment of FIGS. 1–4 detects electrical continuity through the coupling itself. Referring to FIG. 1, a roll-up door 10 includes a pair of vertically extending members such as vertical side frames 12 that supports a roller 14 upon which a flexible roll-up panel, such as a fabric curtain 16, is wound and unwound to respectively open and close the door. In this example, a motor drive unit 18 drives roller 14 to feed panel 16 up and down as vertical slits 20 in frame 12 guide side edges 22 of curtain 16 generally along a vertical plane across the doorway. A lower portion 24 of curtain 16 includes a compliant sealing member 26 at the very bottom or leading edge 28 of the curtain to ensure that the curtain seals against the floor when door 10 is closed.

To help keep curtain 16 within slits 20, as well as help keep curtain 16 taut and square to the doorway under normal operation, and yet still release curtain 16 in the event of a collision, two breakaway couplings 32 releasably couple opposite ends 34 and 36 of lower portion 24 to two opposing carriages 38 or trolleys. In its broadest sense, only one breakaway coupling 32 is needed, but two is preferred. In some embodiments, curtain 16 is kept relatively taut by couplings 32 pulling an elongated member 56, such as a steel cable, in tension. Other examples of elongated member 56 include, but are not limited to, a fabric strap or an integral fabric portion of curtain 16 itself. However, it should be noted that if desired, the leading edge of curtain 16 could be left relatively loose by not applying tension to member 56. In such a case, member 56 would first be forced into tension by exertion of an external force upon the door as could by created by a collision.

To protect a door in the event of a collision, a breakaway feature can be provided by a variety of structures. For example, in this exemplary embodiment, breakaway couplings 32 are attached to first members such as carriages 38 that include rollers 40 attached to a bracket 42. Rollers 40 and bracket 42 conform to the shape of frame 12 (see FIG. 2) to constrain carriage 38 to travel along tracks 44, as door 10 opens and closes. In this example, tracks 44 are provided by the contour of frames 12. Each breakaway coupling 32 includes an inner coupling member 46 that releasably engages an outer coupling member 48 to provide a breakaway connection therebetween. Under normal door operation, couplings 32 remain intact, i.e., their coupling members 46 and 48 remain connected to each other and move together. However, in the event of a collision creating a force sufficient to disconnect either breakaway coupling 32, allowing independent relative movement between the members, the resulting separation of coupling members 46 and 48 protects the rest of the door (especially curtains 16) from damage. A disconnectable coupling or breakaway connection can be provided by any one of a wide variety of available mechanisms including, but not limited to, various fittings that mechanically snap together and apart. However, in some preferred embodiments, the disconnectable joint is provided by magnetic attraction between coupling members 46 and 48. Of course, breakaway couplings may also be provided between trolleys and the rigid bars associated with hard edge doors. The teachings herein are intended to apply to such hard edge doors as well as the soft edge doors specifically described.

In this example, each outer coupling member 48 includes a magnet 50, while each inner coupling member 46 is of a material that is attracted to magnet 50 (e.g., a ferromagnetic material, such as iron or an iron alloy). Magnet 50 is pivotally connected to bracket 42 by way of a hinge 52 that includes a torsional spring 54 that biases the position of magnet 50 generally away from the center of the doorway and towards side frame 12. A similar arrangement is provided at both the right and left side of the doorway. Elongated member 56 connects the two inner coupling members 46 to each other. In this example, the elongated member is a conductor in the form of an electrically conductive steel cable 56 that runs through an elongated aperture 58 extending horizontally across curtain 16.

Under normal operation, cable 56 is kept taut across the width of the doorway by a face 60 of each inner coupling member 46 being magnetically clamped to the magnet 50 of its respective outer coupling member 48. However, when a collision occurs (i.e., the door strikes an obstacle or something strikes the door) that deflects cable 56 with sufficient force to overcome the magnetic attraction of either breakaway coupling 32, the two halves of the coupling will separate, as shown near the left side of FIGS. 3 and 4. Note that outer coupling member 48 being restrained by side frame 12 enhances this action. When this occurs, usually part of the curtain pulls out of slit 20 as well. Also, for the magnet 50 that breaks away, the spring loaded hinge 52 urges the magnet to swing back and magnetically cling to the side of frame 12, which prevents the disengaged trolley 38 from slamming to the floor. Further details of the construction, operation and various alternate embodiments of a magnetic breakaway coupling are disclosed in U.S. Pat. No. 5,638,883, which has already been incorporated by reference herein.

As outer coupling member 48 alternately engages and separates from inner coupling member 46, their mating surfaces, 62 and 60, respectively, can serve as electrical contacts of a switch, i.e., a device whose electrical conductivity changes in response to an action. The switch can be used to convey or interrupt an electrical signal in reaction to the breakaway coupling separating. The electrical signal, in turn, can be used to activate an alarm or inhibit continued normal operation of the door, until the separated coupling and the rest of the door are returned to normal, i.e., each coupling is connected and curtain 16 is properly within slits 20. For the breakaway system of FIGS. 1–4, disabling the operation of door 10 can be carried out by any one of a variety of circuits. In FIG. 1, for example, an electrical power source 64 (e.g., 24 VAC) delivers current in series through a coil 66 of a relay 68, a wire 70, electrically conductive bracket 42, electrically conductive hinge 52, the left outer coupling member 48 (being electrically conductive itself), the left inner coupling member 46 (also being electrically conductive and while engaging magnet 50), cable 56 (or a conductive wire parallel thereto in the case of a nonconductive elongated member), the right inner coupling member 46, the right outer coupling member 48 (while engaging the right inner coupling member 46), right hinge 52, right bracket 42 and a wire 76. Wire 76 leads back to power source 64 to complete a sensing circuit 78 when both breakaway couplings 32 are intact. The completed circuit energizes coil 66 to close relay contacts 80 to be used as desired. For example, in some embodiment, relay contacts 80 enable a motor control circuit 82, such as a conventional reversing motor starter that controls the operation of motor 18. When either coupling 32 breaks away, its corresponding coupling halves 46 and 48, which in this example serve as electrical contacts, separate to interrupt the continuity of sensing circuit 78. When this happens, coil 66 de-energizes to open relay contacts 80, which in turn disables motor control circuit 82 to stop motor 18. Stopping motor 18 avoids jamming the door and damaging curtain 16 by preventing roller 14 from attempting to forcibly raise or lower a curtain that is uncoupled from one or both of its carriages 38. However, it should be appreciated by those skilled in the art, that sensing circuit 78 could be independent of the operation of motor control circuit 82. For example, circuit 78 could be used simply to activate an audible or visual alarm, or increment a counter that indicates how often door 10 has been subjected to an impact that caused it to break away.

The system shown in FIGS. 1–4 thus senses the exertion of a force above a predetermined magnitude on the curtain. To achieve this, sensing circuit 78 is included, and a conductor (cable 56) forms a part of the circuit and extends across the width of the doorway. For normal door operation when no force above the predetermined magnitude is exerted thereon, the conductor is an electrically conductive part of the sensing circuit. When a force above the curtain magnitude is exerted on the curtain, however, the conductor no longer forms a conductive part of the circuit. Here, this is due to the fact that the coupling members separate, electrically isolating the conductor from the remainder of the circuit.

Figure 2:
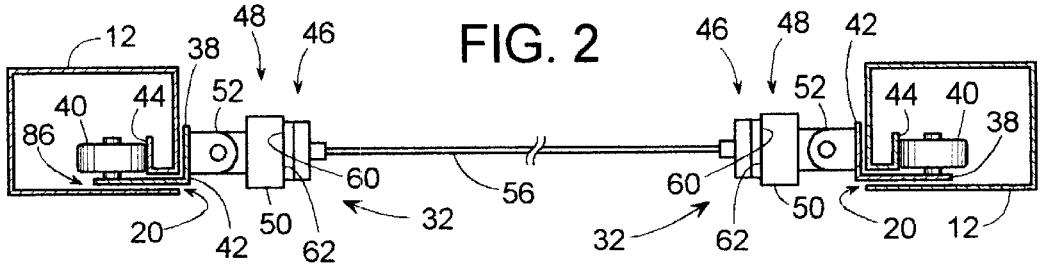
FIG. 2 is a cross-sectional top view taken along line 2—2 of FIG. 1, but with the roll-up panel and wiring leading to the breakaway coupling omitted for clarity.
Figure 3:
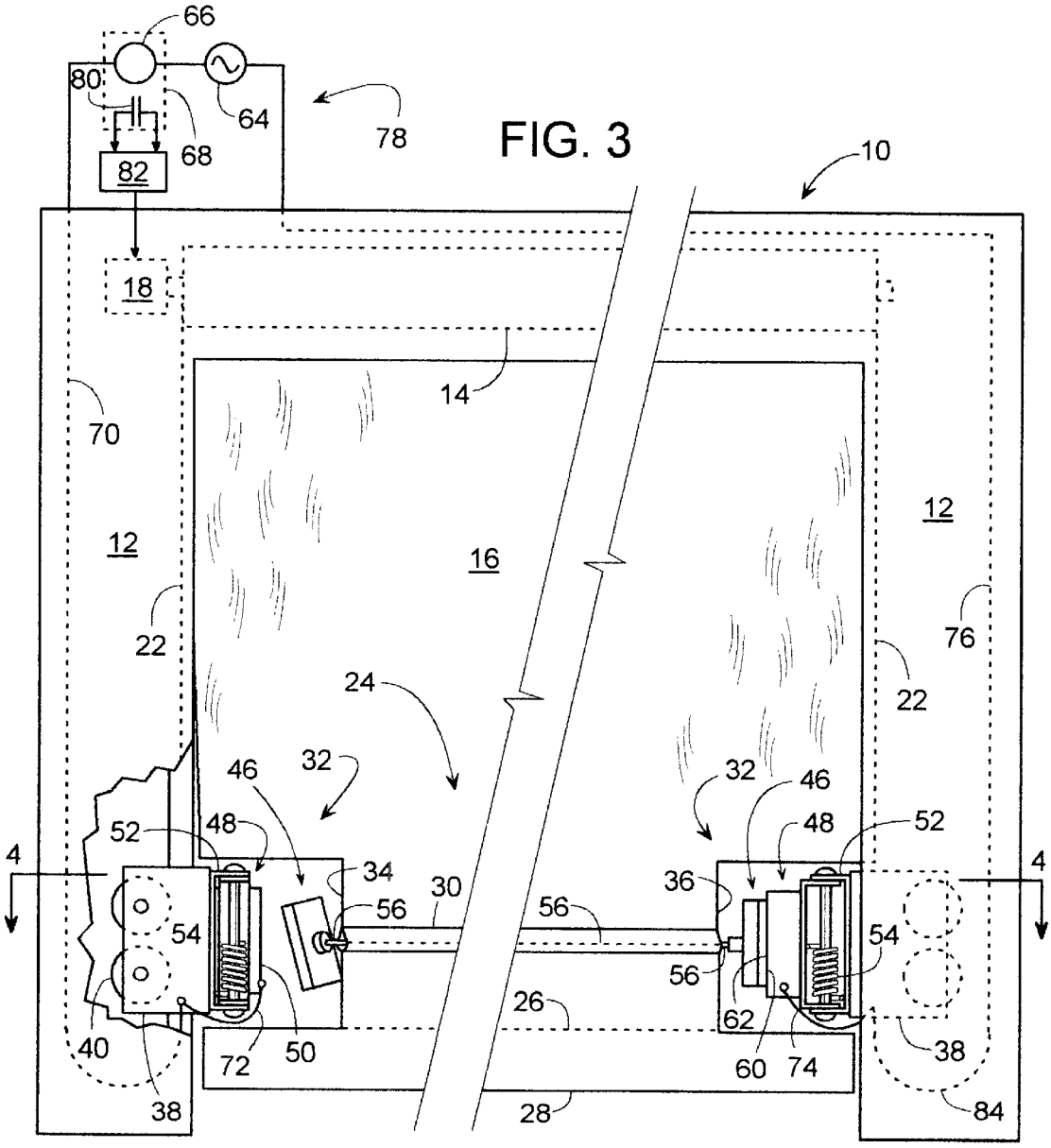
FIG. 3 is the same view as FIG. 1, but with one of the breakaway couplings disengaged.
Figure 6:
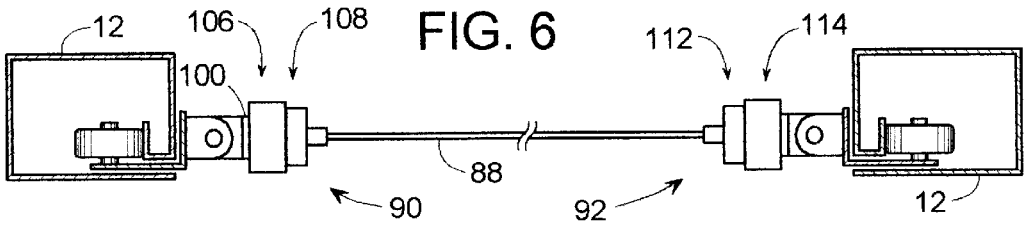
FIG. 6 is a cross-sectional top view taken along line 6—6 of FIG. 5, but with the roll-up panel and wiring leading to the breakaway coupling omitted for clarity.

For the exemplary embodiment just described, it should be appreciated by those skilled in the art, that the wiring diagram of sensing circuit 78 and motor control 82 are schematically illustrated in FIGS. 1 and 3. Much of the circuit and curtain 16 are omitted in FIGS. 2 and 4 to more clearly show other components of the breakaway system. In FIGS. 1 and 3, a simple loop 84 is shown to depict that wires 70 and 76 flex within a flexible cable carrier (e.g., a Model 06-10-028, of IGUS, Inc. from Providence, R.I.) disposed within frame 12 to follow the vertical movement of carriages 38 along tracks 44. However, the actual path along which the wires are laid; the actual positions of the circuit components; and the actual location of where the wiring connects to the components, including carriage 38 and coupling 32, can vary widely depending on personal preference and design details of the specific roll-up door to which the breakaway system is applied. In some embodiments, for example, cable 56 can be replaced by a non-conductive fabric strap with an electrical wire connected parallel thereto that electrically couples the two inner coupling members to each other.

Figure 4:
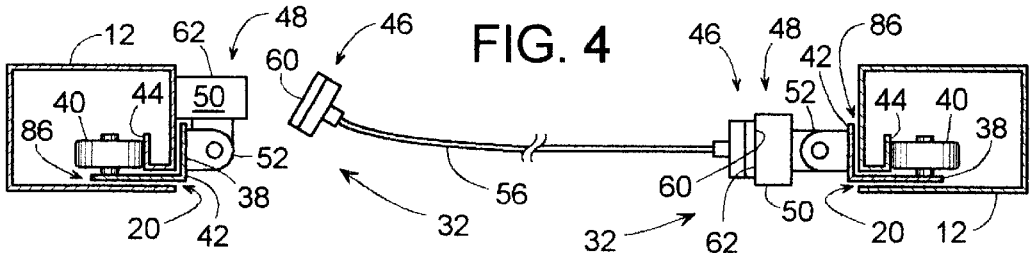
FIG. 4 is a cross-sectional top view taken along line 4—4 of FIG. 3, but with the roll-up panel and wiring leading to the breakaway coupling omitted for clarity.

In some embodiments, some components such as bracket 42 and hinge 52 are relied upon as electrical conductors in lieu of wires or jumpers, such as optional redundant jumper wires 72 and 74. However, when doing so, some precautions need to be taken. For example, when bracket 42 is relied upon as an electrical conductor to complete sensing circuit 78, bracket 42 should be electrically insulated from side frame 12. This can be done by maintaining an air gap 86 between bracket 42 and frame 12 as shown in FIGS. 2 and 4, or by using various electrically resistive plastic bearing pads and rollers to keep the conductive parts of bracket 42 from contacting frame 12 (i.e., shorting out). Jumper wires 72 and 74 are shown as optional conductors to complete circuit 78 in an embodiment where bracket 42 and hinge 52 are not relied upon to conduct electrical current.

If desired, a circuit breaker or resettable fuse (e.g., a Model MF-R020, of Bourns, Inc. of Riverside Calif.) can be used to protect circuit 78 in the event of an electrical short or current overload. This is particularly important, as magnet 50 short circuits circuit 78 to a grounded frame 12 whenever coupling 32 associated with the magnet breaks away. It should be further noted that while the conductor in this embodiment, which extends across the width of the doorway and selectively either forms or does not form a conductive part of the sensing circuit, is carried on the door curtain, this need not be so. Rather, the conductor could extend across the width of the doorway at other locations and still perform its conducting/non-conducting function.

The embodiment of FIGS. 5–8 is similar to the one just described, however, cable 56 is replaced by a two-conductor cable 88. And each breakaway coupling 90 and 92 has two sets of electrical contacts for a total of eight contacts 94*a–h* with contacts 94*d* and 94*e* sharing a common node at magnet 50. Contacts 94*a* and 94*h* are respectively provided by separate magnets 96 and 98 that are electrically conductive, but are insulated from hinge 52 and carriage 38 by way of a nonconductive shim 100. Each inner coupling member 108 and 112 includes an electrically nonconductive core 101 that electrically separates its respective contacts 94*b* and 94*g* (coupling member 108) and contacts 94*c* and 94*f* (coupling member 112). This arrangement allows wires 102 and 104 to share a common cable carrier disposed inside just one side frame 12 (e.g., the left or right side of the doorway).

Figure 5:
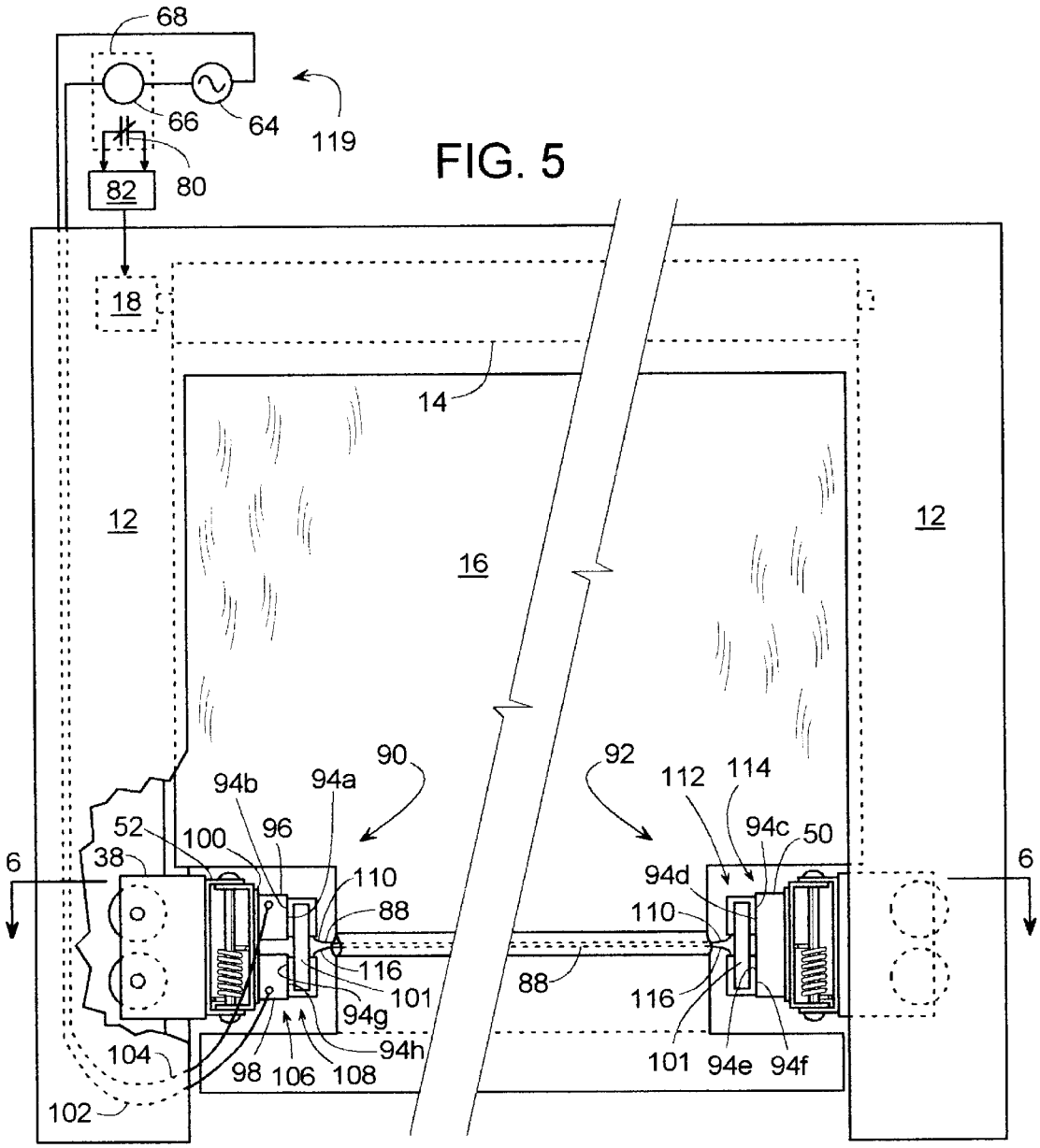
FIG. 5 is a front view of another embodiment with a cut-away portion showing a breakaway coupling.

Referring to FIG. 5, under normal door operation, power source 64 delivers current in series through coil 66, wire 104, magnet 96, a first contact 94*a* of a left outer coupling member 106, a second contact 94*b* of a left inner coupling member 108, a first wire 110 of cable 88, a third contact 94*c* of a right inner coupling member 112, a fourth contact 94*d* of a right outer coupling member 114, magnet 50, a fifth contact 94*e*, a sixth contact 94*f*, a second wire 116 of cable 88, a seventh contact 94*g* of left inner coupling member 108, magnet 98, and wire 102. Wire 102 leads back to power source 64 to complete a sensing circuit 119 when both breakaway couplings 90 and 92 are intact. The completed circuit energies coil 66 to close relay contacts 80, which enable the operation of motor 18 to open or close the door.

Figure 8:
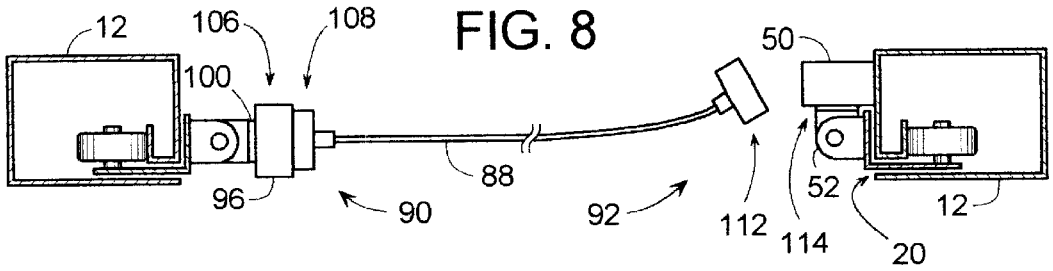
FIG. 8 is a cross-sectional top view taken along line 8—8 of FIG. 7, but with the roll-up panel and wiring leading to the breakaway coupling omitted for clarity.
Figure 7:
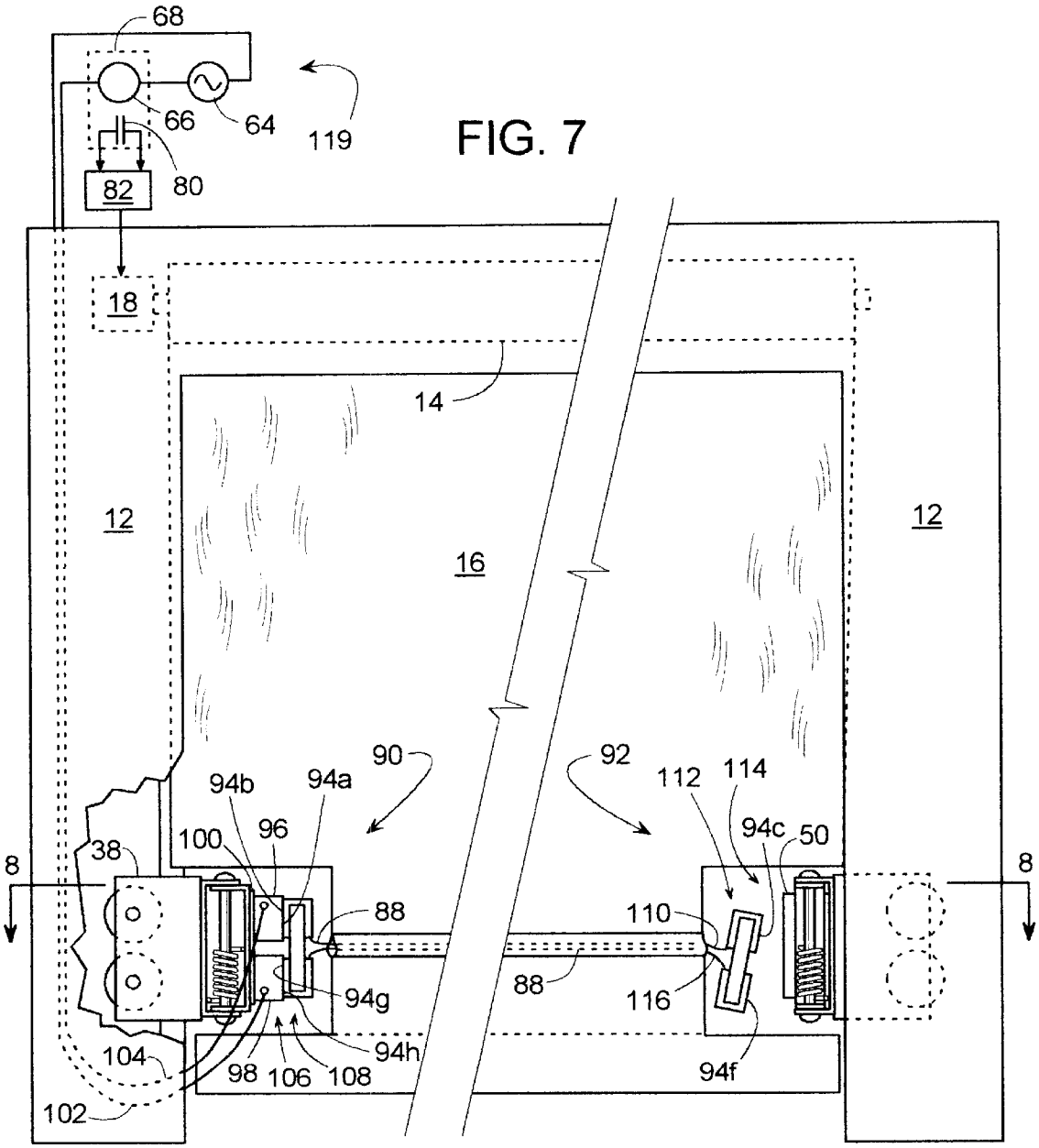
FIG. 7 is the same view as FIG. 5, but with one of the breakaway couplings disengaged.
Figure 10:
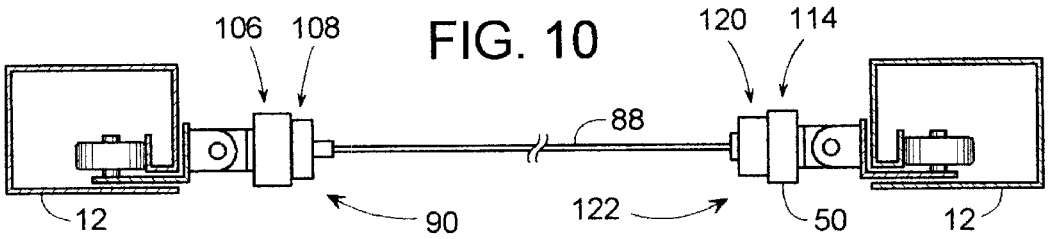
FIG. 10 is a cross-sectional top view taken along line 10—10 of FIG. 9, but with the roll-up panel and wiring leading to the breakaway coupling omitted for clarity.
Figure 9:
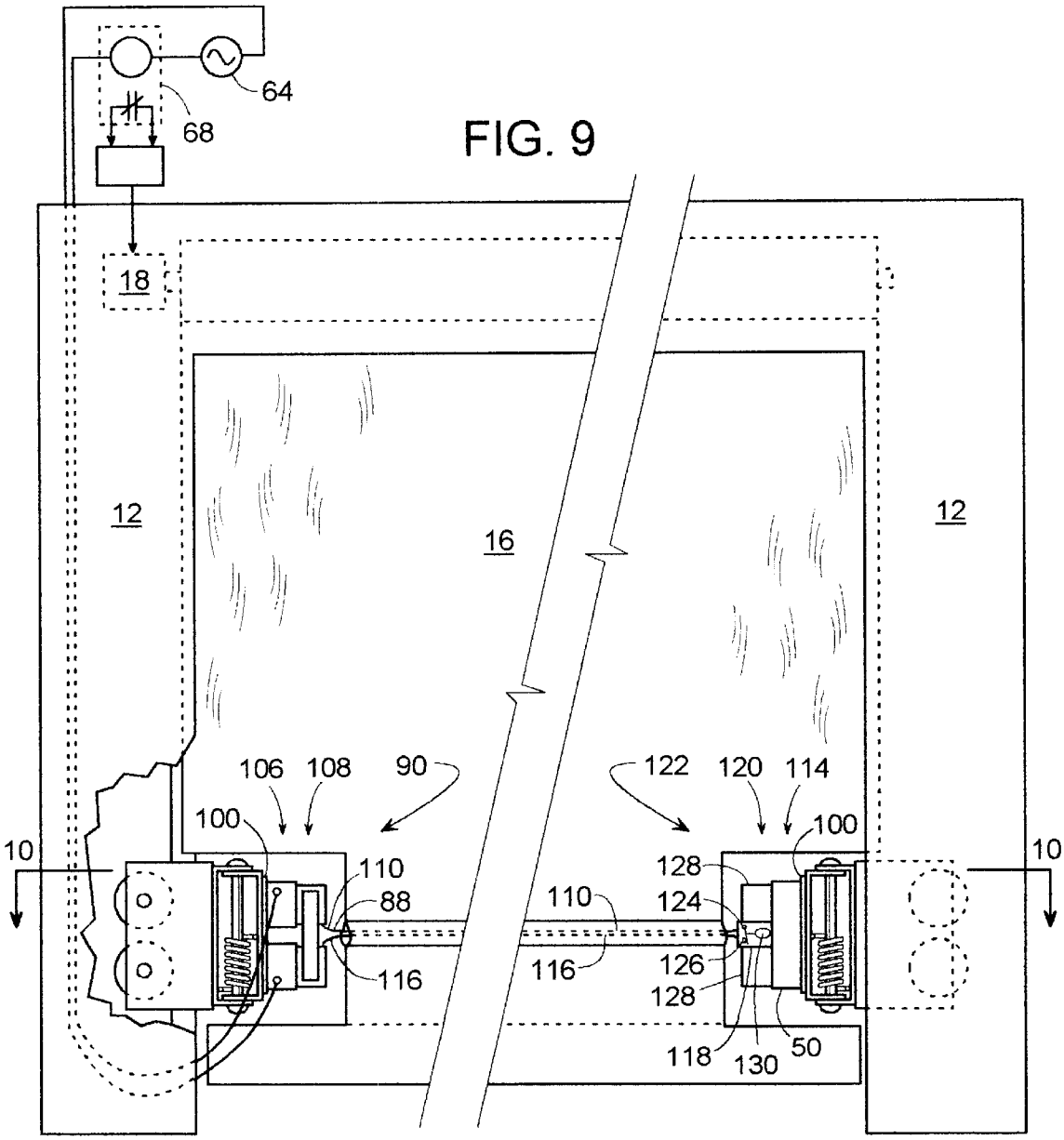
FIG. 9 is a front view of another embodiment with a cut-away portion showing a breakaway coupling.

When either coupling 90 or 92 breaks away in reaction to a collision, its corresponding coupling halves separate to interrupt the continuity of sensing circuit 119. If coupling 92 on the right breaks away, as shown in FIGS. 7 and 8, contact 94*c* and 94*f* separate from the combined contacts 94*d* and 94*e* that are disposed on the face of magnet 50. If coupling 90 on the left breaks away, contacts 94*a* and 94*b* separate, and so do contacts 94*g* and 94*h*. If either coupling 90 or 92 separates, the continuity of circuit 119 is interrupted to disable the operation of motor 82, thus stopping the opening or closing of the door. The door is reset to normal operation by placing curtain 16 back into slits 20 and reconnecting the two halves of each breakaway coupling 90 and 92 that may have separated.

Although inner coupling halves 108 and 112 are shown connected to each other by cable 88, in some embodiments, another elongated member such as a fabric strap or an integral portion of the door curtain itself extends across the width of curtain 16 and generally parallel to cable 88 to hold the two halves 108 and 112 together, which thus relieves the tension in wires 110 and 116 of cable 88.

Figure 12:
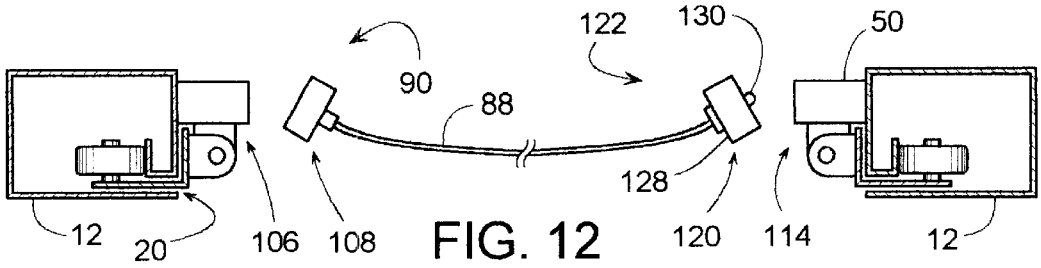
FIG. 12 is a cross-sectional top view taken along line 12—12 of FIG. 11, but with the roll-up panel and wiring leading to the breakaway coupling omitted for clarity.
Figure 11:
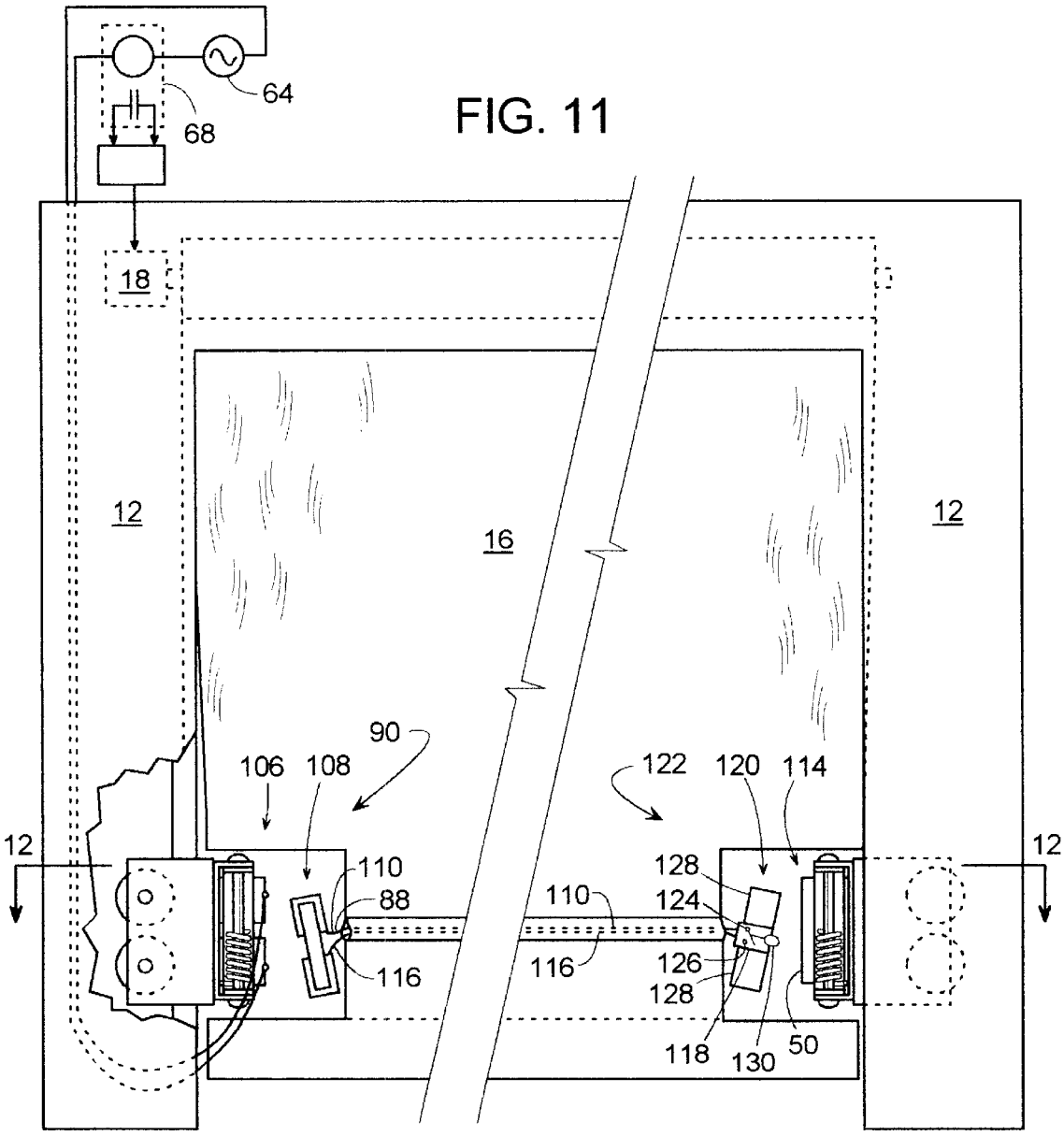
FIG. 11 is the same view as FIG. 9, but with both of the breakaway couplings disengaged.
Figure 14:
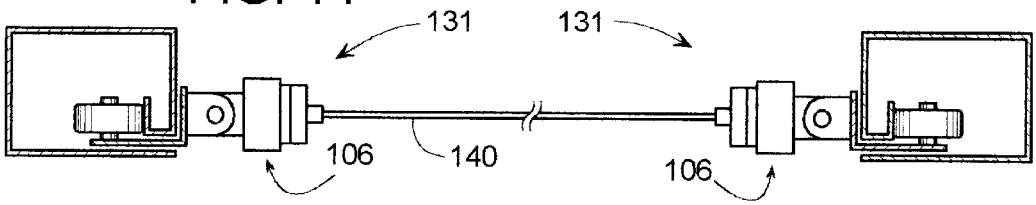
FIG. 14 is a cross-sectional top view taken along line 14—14 of FIG. 13, but with the roll-up panel and wiring leading to the breakaway coupling omitted for clarity.
Figure 13:
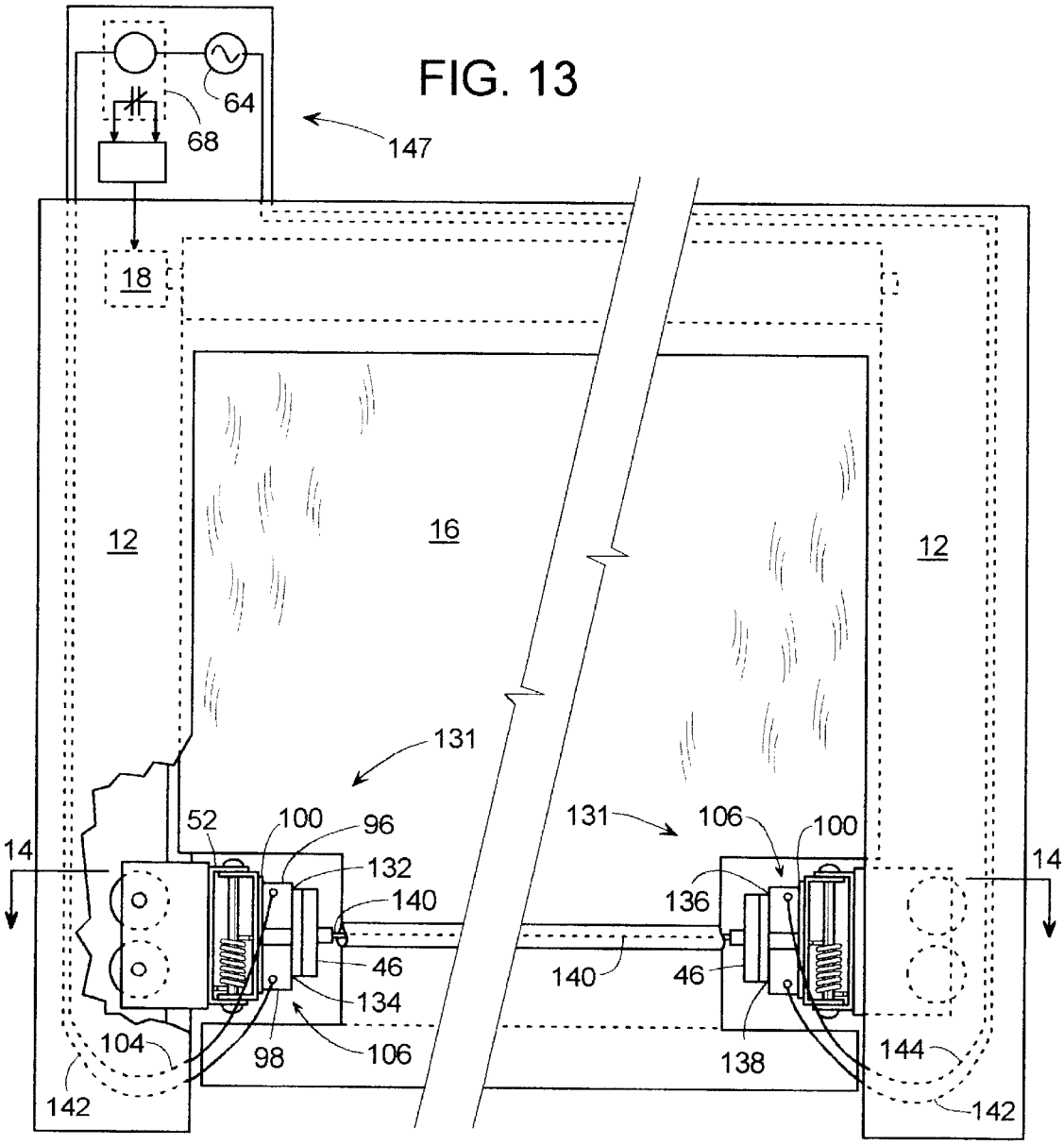
FIG. 13 is a front view of another embodiment with a cut-away portion showing a breakaway coupling.
Figure 16:
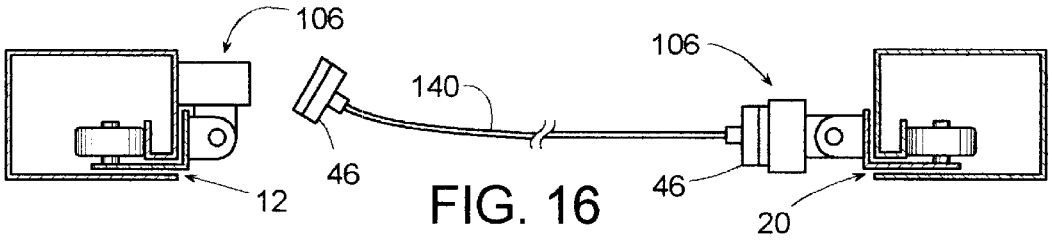
FIG. 16 is a cross-sectional top view taken along line 16—16 of FIG. 15, but with the roll-up panel and wiring leading to the breakaway coupling omitted for clarity.
Figure 15:
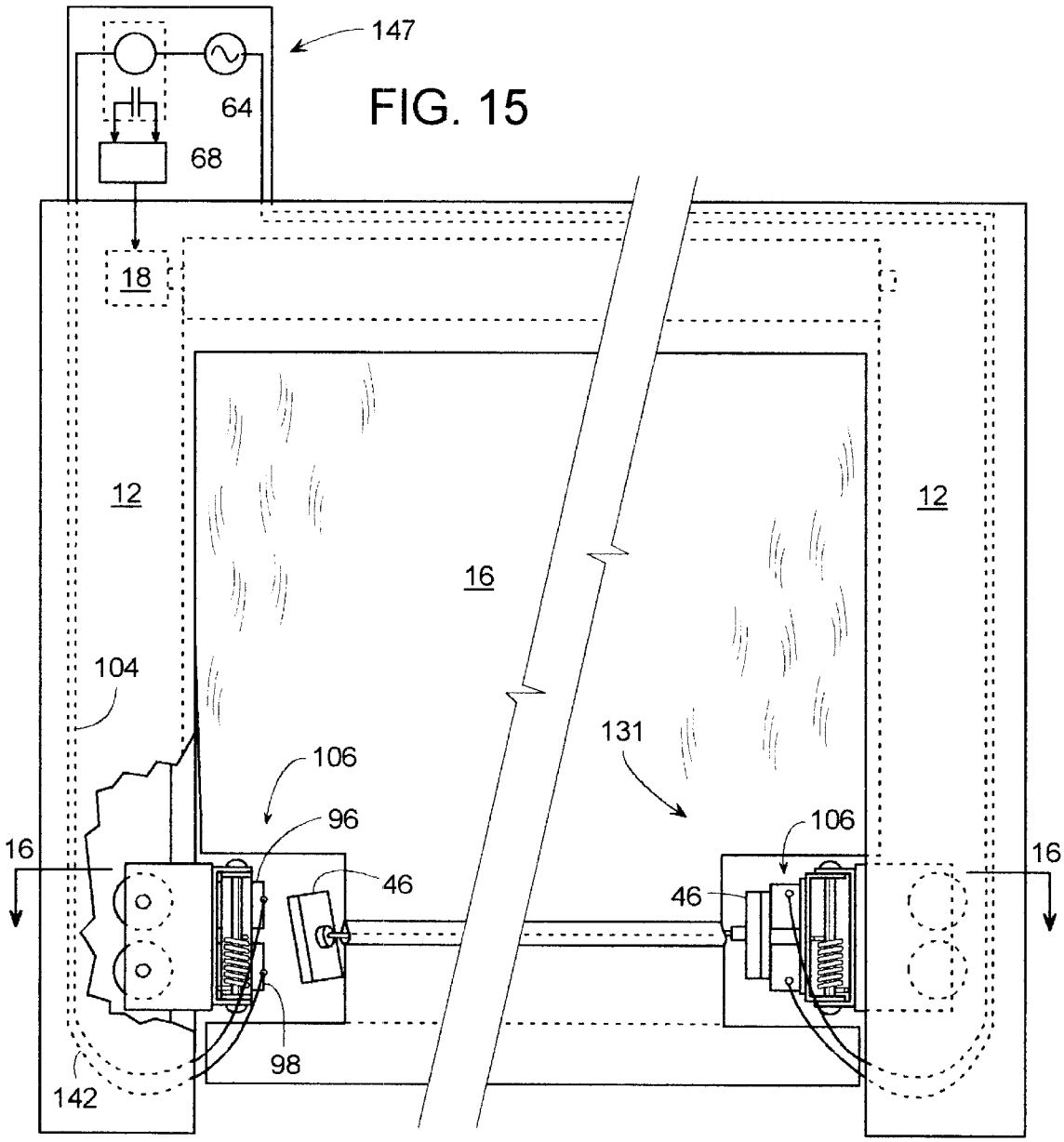
FIG. 15 is the same view as FIG. 13, but with one of the breakaway couplings disengaged.

In a similar embodiment, shown in FIGS. 9–12, contacts 94*c,d,e,f* of FIGS. 5 and 7 are replaced by an electrical switch 118. Switch 118 is disposed on a right inner coupling member 120 of a breakaway coupling 122 and includes open biased contacts 124 and 126 that are held closed during normal operation of the door. Magnet 50 of outer coupling member 114 at the right side of the door magnetically clings to ferromagnetic blocks 128 that are on inner coupling member 120. As magnet 50 magnetically clamps against blocks 128, magnet 50 also depresses a switch actuator 130 that closes contacts 124 and 126 of switch 118. When closed, contacts 124 and 126 provide electrical continuity between wires 110 and 116. That continuity was previously provided by contacts 94*c, d, e, f* of the embodiment of FIGS. 5–8. When coupling 122 breaks away, as shown in FIGS. 11 and 12, actuator 130 returns to its normally extended position to open contacts 124 and 126 (i.e., break their continuity). This interrupts the current to relay 68 to activate an alarm, or disable motor 18 to stop the door.

The left breakaway coupling 90 of FIGS. 9–12 is the same as the one in the embodiment of FIGS. 5–8. It might also be noted that in FIGS. 11 and 12, both breakaway couplings 90 and 122 are shown in their uncoupled state, as this could actually occur in some collisions.

In some applications, it might be beneficial to eliminate the need to extend an electrical conductor across the width of the door curtain. This is accomplished in the embodiment of FIGS. 13–16, wherein both breakaway couplings 131 are basically the same, and their outer coupling halves 106 are the same as the left outer one of FIGS. 9–12. Each outer coupling member 106 includes a pair of spaced-apart magnets 96 and 98 that are electrically insulated from the rest of the coupling member by way of electrically nonconductive shim 100 between hinge 52 and magnets 96 and 98. Each pair of magnets 96 and 98 provide a corresponding pair of electrical contacts: 132 and 134 on the left and 136 and 138 on the right. Each pair of contacts are shorted out (i.e., electrically connected to each other) by an inner coupling member 46, which is the same as those used in the embodiment of FIGS. 1–4. However, the two inner coupling halves 46 are connected to each other by an elongated member 140 that does not need to be electrically conductive, such as for example, a cable, strap, or an integral portion of the door curtain itself.

During normal door operation, power supply 64 delivers current in series through relay 68, wire 104, contacts 132, left inner coupling member 46, contacts 134, a second wire 142 that leads up and over to the right breakaway coupling 131, contacts 138, right inner coupling member 46, contacts 136 and wire 144. Wire 144 leads back to power supply 64 to complete a sensing circuit 147 that energizes relay 68 to enable motor 18 to open or close the door.

When either of couplings 131 are forced to break away, the separation of an inner coupling member 46 from its corresponding outer coupling member 106 opens contacts 132 and 134 or 136 and 138, accordingly. In the example shown in FIGS. 15 and 16, the left breakaway coupling 131 separates to interrupt the continuity of circuit 147, which de-energizes relay 68 to disable the normal operation of the door. The door is returned to normal operation by placing curtain 16 back into slits 20 and reconnecting the two halves of the left breakaway coupling 131.

Figure 18:
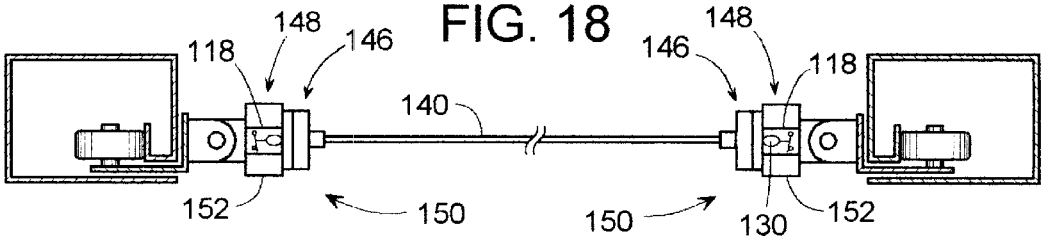
FIG. 18 is a cross-sectional top view taken along line 18—18 of FIG. 17, but with the roll-up panel and wiring leading to the breakaway coupling omitted for clarity.
Figure 17:
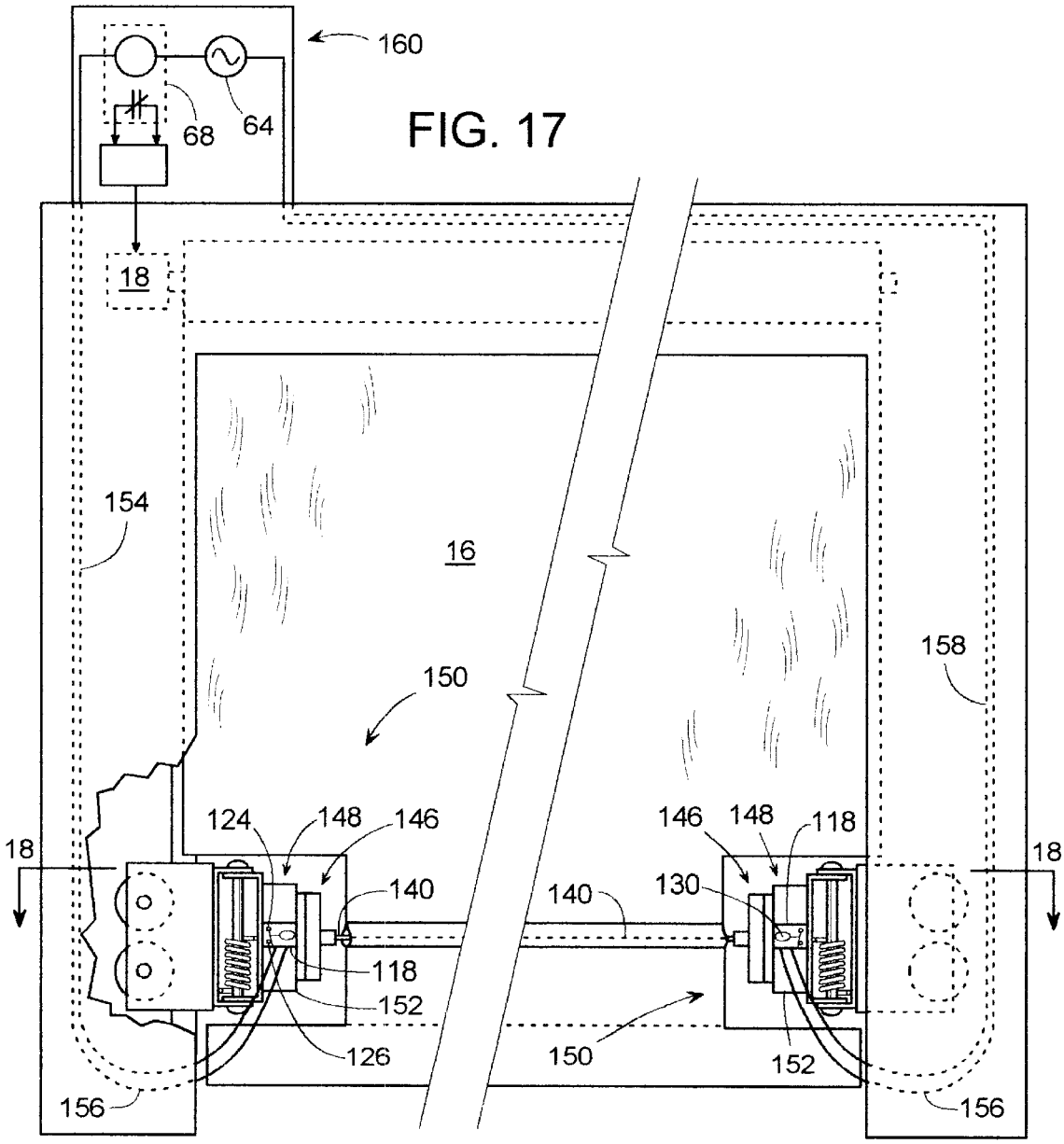
FIG. 17 is a front view of another embodiment with a cut-away portion showing a breakaway coupling.
Figure 20:
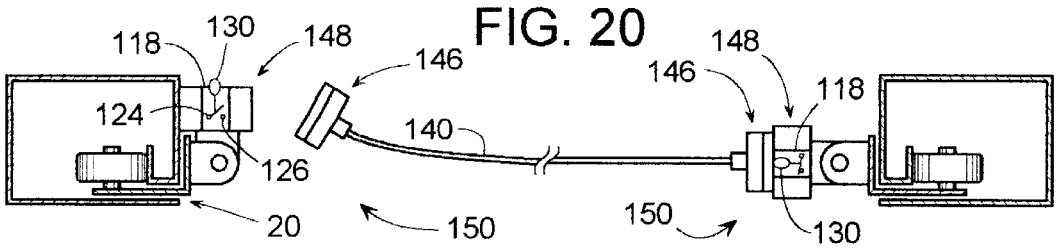
FIG. 20 is a cross-sectional top view taken along line 20—20 of FIG. 19, but with the roll-up panel and wiring leading to the breakaway coupling omitted for clarity.
Figure 19:
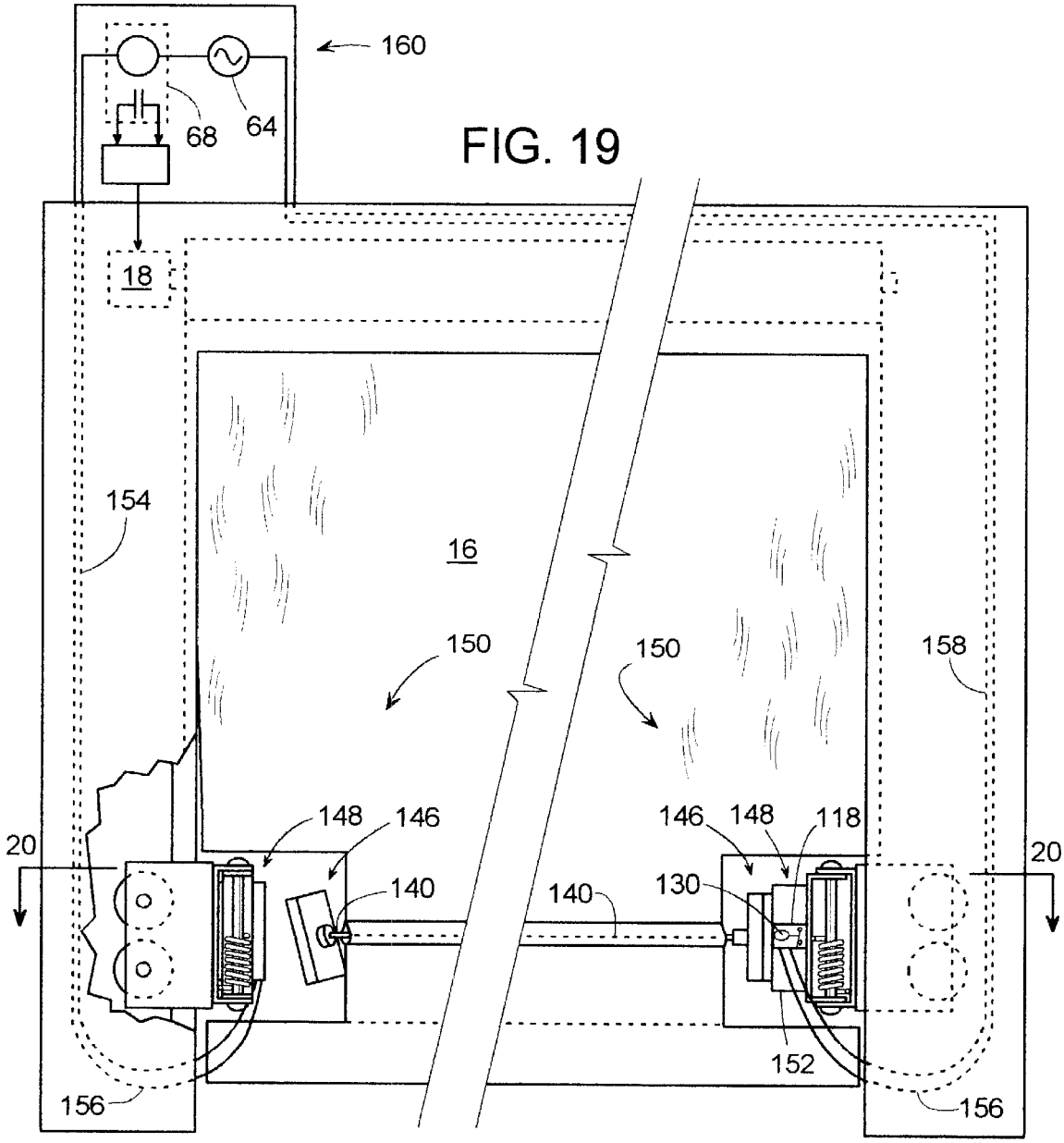
FIG. 19 is the same view as FIG. 17, but with one of the breakaway couplings disengaged.
Figure 22:
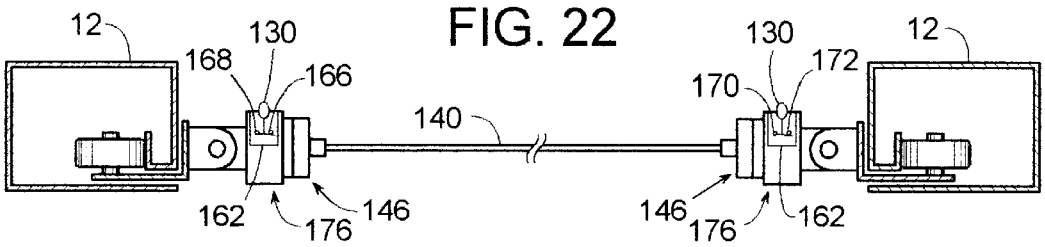
FIG. 22 is a cross-sectional top view taken along line 22—22 of FIG. 21, but with the roll-up panel and wiring leading to the breakaway coupling omitted for clarity.
Figure 21:
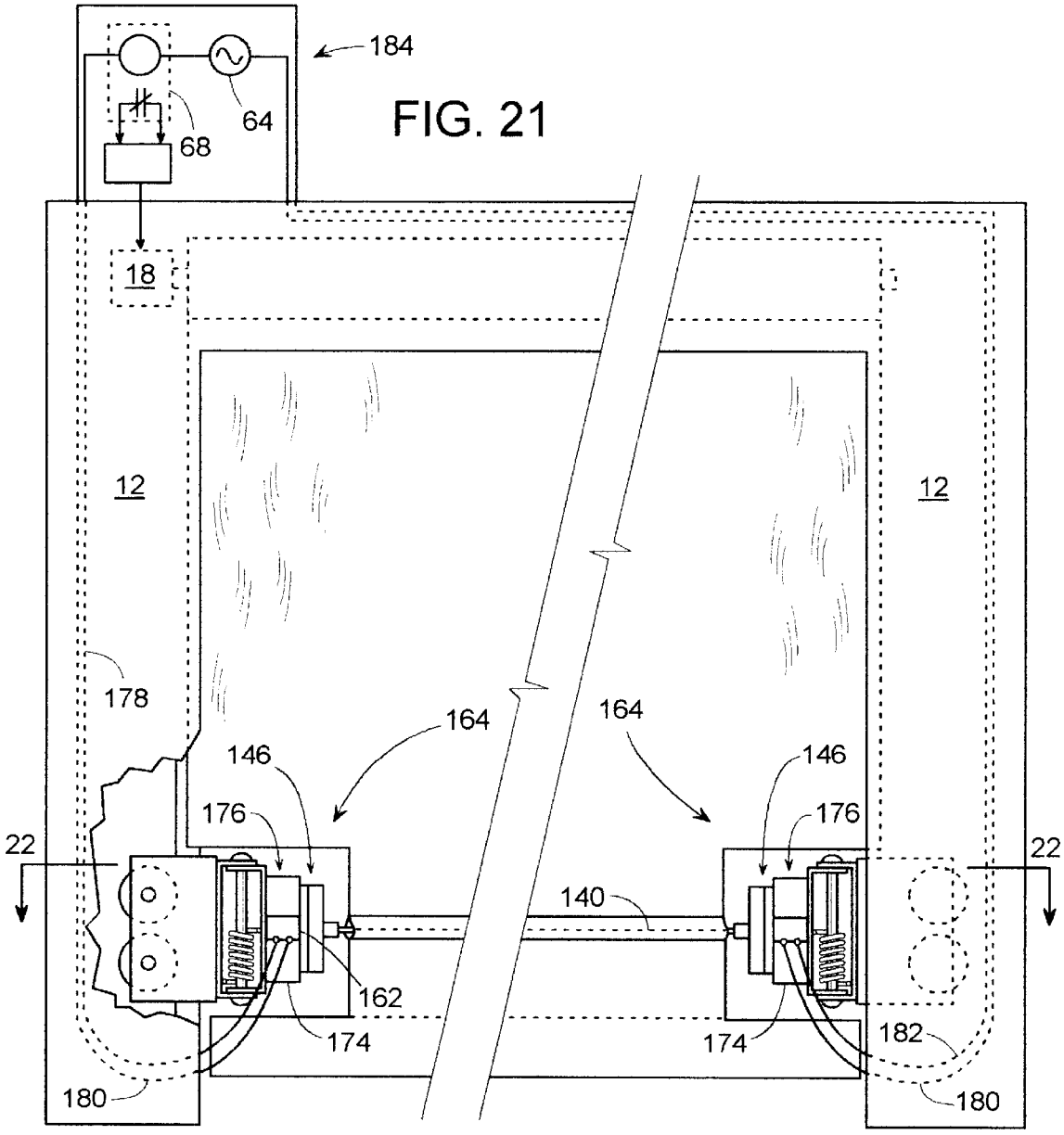
FIG. 21 is a front view of another embodiment with a cut-away portion showing a breakaway coupling.

Another breakaway system that eliminates the need for extending an electrical conductor across the width of the door curtain is shown in FIG. 17–20. In this example, switch 118 (described earlier in reference to FIGS. 9–12) is attached to each outer coupling member 148 of breakaway couplings 150. Each switch 118 is disposed within or adjacent a magnet 152 with the switch's actuator 130 depressed by an inner coupling member 146 that is magnetically drawn up against magnet 152, as shown in FIGS. 17 and 18. The two inner coupling halves 146 are connected to each other by elongated member 140 that does not need to be electrically conductive, such as for example, a cable, strap, or an integral portion of the door curtain itself.

During normal operation of the door, current from power supply 64 passes in series through relay 68, a wire 154, closed contacts 124 and 126 on the left breakaway coupling, a wire 156, closed contacts 124 and 126 on the right breakaway coupling, and back to power supply 64 through a wire 158 to complete the continuity of a sensing circuit 160. This energizes relay 68 to enable motor 18 to open or close the door.

When either of couplings 159 are forced to break away, the separation of an inner coupling member 146 from its corresponding outer coupling member 148 allows the switch actuator 130 associated with the separated coupling to open its contacts 124 and 126. In the example shown in FIGS. 19 and 20, the left breakaway coupling 150 separates to interrupt the continuity of circuit 160, which de-energizes relay 68 to disable the normal operation of the door. The door is returned to normal operation by placing curtain 16 back into slits 20 and reconnecting the two halves of the left breakaway coupling 150.

FIGS. 21–24 illustrate another embodiment of a breakaway system that is very similar to the embodiment of FIG. 17–20. However, instead of switches 118 with normally open contacts held closed, the breakaway system employs switches 162 that have normally closed contacts. One switch 162 on a left breakaway coupling 164 has contacts 166 and 168, and another switch 162 on the right breakaway coupling 164 has contacts 170 and 172. Each breakaway coupling includes a magnet 174 on an outer coupling member 176 that magnetically clings to inner coupling member 146. The two inner coupling halves 146 are connected to each other by elongated member 140 that does not need to be electrically conductive, such as the examples mentioned earlier.

During normal operation of the door, current from power supply 64 passes in series through relay 68, a wire 178, normally closed contacts 166 and 168 on the left breakaway coupling, a wire 180, normally closed contacts 170 and 172 on the right breakaway coupling, and back to power supply 64 through a wire 182 to complete the continuity of a sensing circuit 184. This energizes relay 68 to enable motor 18 to open or close the door.

Figure 24:
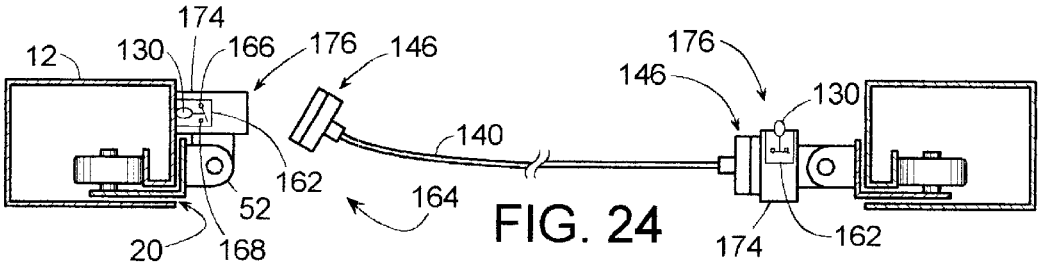
FIG. 24 is a cross-sectional top view taken along line 24—24 of FIG. 23, but with the roll-up panel and wiring leading to the breakaway coupling omitted for clarity. .
Figure 23:
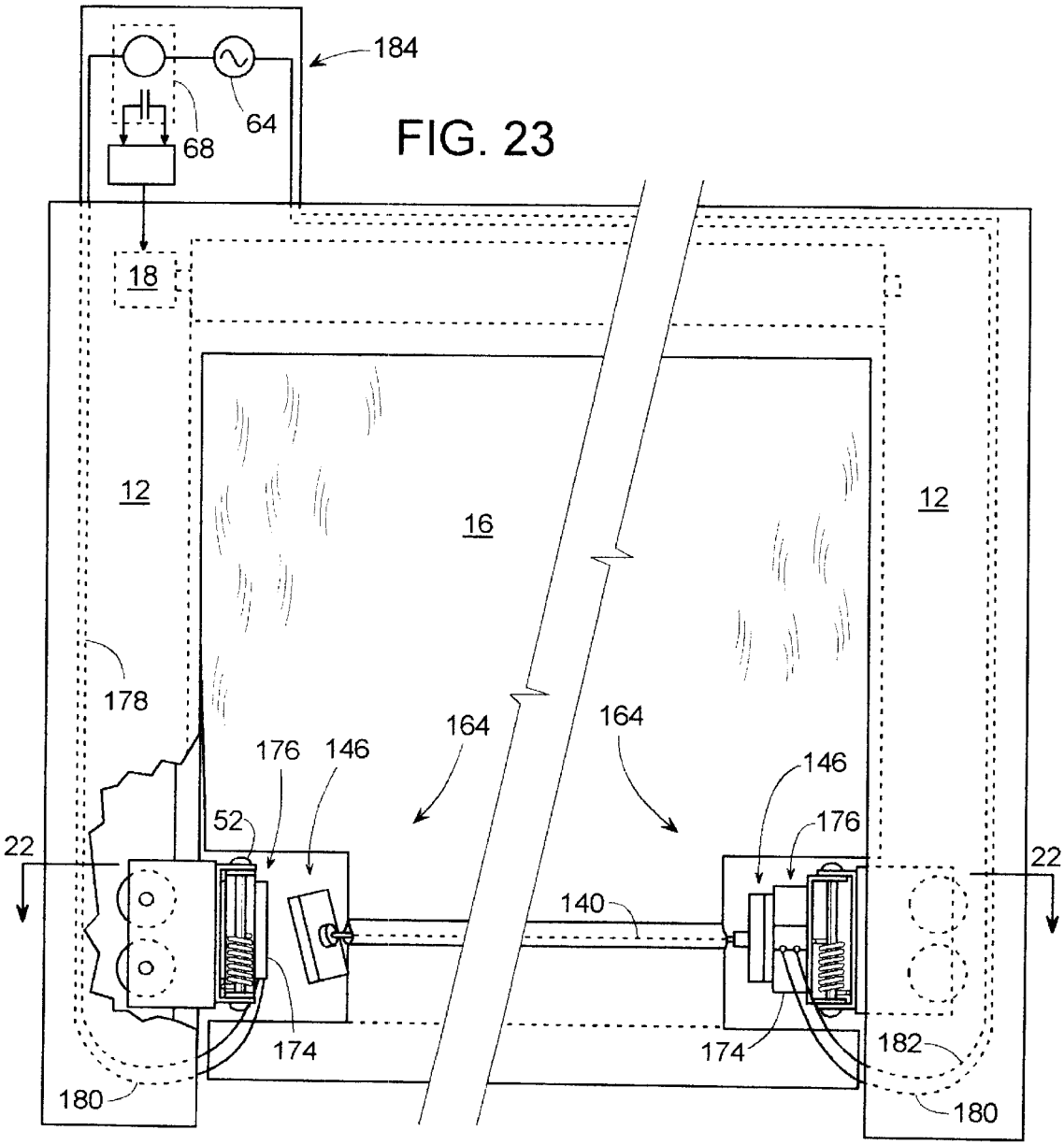
FIG. 23 is the same view as FIG. 21, but with one of the breakaway couplings disengaged.

When a coupling 164 breaks away, for example, the left breakaway coupling 164 of FIGS. 23 and 24, the coupling's spring-loaded hinge 52 swings its magnet 174 and its adjacent switch 162 up against the side of frame 12. The side of frame 12 depresses the switch's actuator 130 to open contacts 166 and 168, which interrupts the continuity of circuit 184. This, in turn, de-energizes relay 68 to disable the normal operation of the door. Although frame 12 is the structure that actuates switch 162 as hinge 52 moves the switch, the actuation could be carried out by a variety of other structures in the vicinity, including but not limited to the hinge itself. The door is returned to normal operation by placing curtain 16 back into slits 20 and reconnecting the two halves of the left breakaway coupling 164.

Although the invention is described with respect to preferred embodiments, modifications thereto will be apparent to those skilled in the art. For example, in providing a breakaway coupling that includes two coupling halves that are magnetically attracted to each other, either coupling member could be the magnet with the other coupling member being of a material attracted to the magnet. Also, one coupling member could be an integral component or extension of carriage 38 itself. For instance, it is well within the scope of the invention to eliminate hinge 52 and provide an inner coupling member with a magnet that clings directly to bracket 42 of carriage 38. In such a case, the portion of bracket 42 that engages the magnet would serve as the outer coupling member. Since other modifications will be apparent to those skilled in the art, the scope of the invention is to be determined by reference to the claims, which follow.

I claim:

1. A system responsive to a force above a certain magnitude, the system comprising:

a door that is moveable, during a normal operation of the door, between an open position and a closed position relative to a doorway opening having a width; and a sensing circuit adapted to sense the force exceeding the certain magnitude and being exerted on the door, and including a conductor which is in a conductive state during the normal operation of the door to provide the sensing circuit with an electrically conductive path that extends substantially across the width of the doorway opening to conduct current substantially across the width of the doorway opening and which changes to a nonconductive state in response to the force exceeding the certain magnitude.

2. The system of claim 1, further comprising a vertically-extending member disposed adjacent a lateral edge that at least partially defines the doorway opening, and a first member associated with the vertically extending member, wherein the conductor is releasably coupled to the first member such that the conductor and the vertically-extending member have a coupled state and an uncoupled state, wherein the conductor and the first member are in the coupled state during the normal operation of the door to place the conductor and first member in electrically conductive contact with each other, and wherein the conductor and the first member are otherwise in the uncoupled state to electrically separate the conductor from the first member.

3. The system of claim 2, wherein at least one of the conductor and the first member includes a magnet.

4. The system of claim 2, wherein the conductor and the first member comprise a first set of electrical contacts that is connected electrically in series with a second set of electrical contacts that are provided by the conductor and a second member associated with a second vertically-extending member disposed along an opposite lateral edge of the doorway opening.

5. A door including a system responsive to a force above a certain magnitude being exerted on the door, wherein during a normal operation of the door, the door is moveable between an open position and a closed position relative to a doorway opening at least partially defined by a lateral edge, and comprising in combination:

a vertically-extending member disposed adjacent to the lateral edge of the doorway opening;

a first member associated with the vertically-extending member;

a door panel capable of movement between the open position and the closed position;

a sensing circuit adapted to sense the force exceeding the certain magnitude; and including a conductor releasably coupled to the first member such that the conductor and the first member have a coupled state and an uncoupled state, wherein the conductor and the first member are in the coupled state and move together during the normal operation of the door to place the conductor and first member in electrically conductive contact with each other such that current is conducted through the coupled conductor and the first member, and wherein the conductor and the first member are otherwise in the uncoupled state wherein they are capable of independent relative movement to electrically separate the conductor from the first member.

6. The door including the system of claim 5, wherein the conductor and the first member comprise a first set of electrical contacts that is connected electrically in series with a second set of electrical contacts that are provided by the conductor and a second member associated with a second vertically-extending member disposed along an opposite lateral edge of the doorway opening.

7. A method of controlling an electrical current used to signal the separation of a breakaway coupling that selectively couples and uncouples a roll-up panel to a carriage, wherein the carriage travels along a track to help guide the roll-up panel, comprising:

conveying the electrical current through the breakaway coupling;

uncoupling the roll-up panel from the carriage by way of the breakaway coupling; and sensing the interruption of the electrical current through the breakaway coupling upon uncoupling the roll-up panel from the carriage.

8. The method of claim 7, further comprising urging the breakaway coupling to couple the roll-up panel to the carriage by way of magnetic attraction.

9. The method of claim 7, further comprising conveying the electrical current in series through the breakaway coupling and a second breakaway coupling, wherein the breakaway coupling and the second breakaway coupling are disposed at opposite ends of the roll-up panel.

* * * * *